US006094895A

United States Patent [19]

Ravizza

[11] Patent Number: 6,094,895

[45] Date of Patent: Aug. 1, 2000

[54] METHOD AND APPARATUS FOR THE PACKAGING OF ARTICLES WITHIN FLEXIBLE MATERIAL BAGS

[75] Inventor: Roberto Ravizza, Rivoli, Italy

[73] Assignee: Ravizza Packaging S.r.l., Alpignano, Italy

[21] Appl. No.: 09/213,362

[22] Filed: Dec. 17, 1998

[30] Foreign Application Priority Data

Dec. 17, 1997 [IT] Italy ..... TO97A1105

[51] Int. Cl.[7] ..... B65B 9/14

[52] U.S. Cl. ..... 53/567; 53/570; 53/384.1

[58] Field of Search ..... 53/459, 452, 492, 53/567, 570, 384.1

[56] References Cited

U.S. PATENT DOCUMENTS

| | | | |
|---|---|---|---|
| 2,612,738 | 10/1952 | Salfisberg . | |
| 3,448,557 | 6/1969 | Swaithes | 53/452 |
| 4,094,125 | 6/1978 | Gess | 53/452 |
| 4,244,159 | 1/1981 | Gess | 53/567 |
| 4,338,761 | 7/1982 | Gess | 53/567 |
| 4,516,384 | 5/1985 | Imperiale | 53/459 |

FOREIGN PATENT DOCUMENTS

| | | | |
|---|---|---|---|
| 32 34 877 | 3/1984 | Germany . | |
| 0639760 | 1/1979 | Russian Federation | 53/384.1 |
| 0706291 | 12/1979 | Russian Federation | 53/384.1 |
| 2010213 | 6/1979 | United Kingdom | 53/384.1 |

*Primary Examiner*—John Sipos
*Attorney, Agent, or Firm*—Sughrue, Mion, Zinn, Macpeak & Seas, PLLC

[57] ABSTRACT

A continuous web flexible material having a tubular or a single-fold configuration is intermittently fed to a fill-in station of the articles to be packed. The web is transversely out so as to form a web length of a desired size whose edges are mutually spread apart and then held upon filling up of the articles. Releasable adhesive grasp members are provided to spread apart the edges of the web length.

5 Claims, 6 Drawing Sheets

METHOD AND APPARATUS FOR THE PACKAGING OF ARTICLES WITHIN FLEXIBLE MATERIAL BAGS

BACKGROUND OF THE INVENTION

The present invention is related to packaging of articles within flexible material containers preferably, but not necessarily, provided from a continuous web formed by two superimposed flat layers mutually joined to each other at least along one longitudinal edge thereof. Such webs considered suitable in connection with the packaging technique according to the invention may be constituted by a heat-weldable plastic material tubular film (and accordingly the two superimposed film layers shall evidently be mutually joined along both longitudinal edges thereof), or by a single-fold film also made of a heat-weldable plastic material (and in that case the two film layers shall evidently be mutually joined only along one longitudinal edge thereof). As it will be apparent in the following, the invention may be carried out not only in connection with plastic material films, but even as far as flexible material webs of different types are concerned, such as for instance coupled paper/plastic films, plastic film/plastic films, aluminium/plastic films, aluminium/polythenated paper and other multi-coupled webs. Moreover the invention can also be advantageously carried into effect in connection with packaging systems employing, instead of a continuous web, envelopes or the like flexible material containers having been previously pre-formed according to a substantially flat arrangement, with two edges designed to be mutually spread apart so as to allow introduction of the articles to be packaged therethrough.

From Italian Patent application IT-A-67207/96 an automatic machine for the packaging of articles starting from a plastic-material flat tubular film is known, which comprises a fill-in station to which the tubular film is fed to be then transversely cut so as to form a web length of a desired size. The apparatus further comprises means to spread apart the cut edges of the tubular film web length, grasp means to hold the edges during filling in of the articles, and means to sealingly close said edges following filling in. In this known apparatus the means to spread apart the cut edges of the web length comprise two nozzle assemblies to supply a flow of air under pressure substantially tangentially to the cut edges, so as to produce mutual spacing apart thereof under aerodynamic effect. The tubular film edges are thus moved towards respective abutment surfaces against which these edges are then engaged so as to be then further spaced apart from each other thereby bringing the film length into an open-bag configuration adapted to receive the articles to be packaged. At the end of the filling operation the edges are again brought near each other and sealingly closed by heat welding.

This known apparatus with the related air jet spreading system, while having proved sufficiently practical and functional, is affected by several limits and drawbacks.

The main limit is related to the type of material which can be employed for the packaging: this material, in order to ensure the necessary operative reliability of the pneumatic spreading apart system, can be neither too thin, nor too thick, since in both cases the correct mutual opening of the edges of the web lengths every time fed to the fill-in station might fail: actually a very thin material may give rise to fluttering of the edges under the air jets, while with a very thick material the air jets may produce no useful effect on the web length edges. Thus in practice the web which can be employed with the above reference known apparatus is as a rule consisting of a tubular polyethylene film having a thickness of about 0.6–0.13 mm. It would be instead desirable employing different and even more valuable materials, such as multi-coupled webs (paper/plastic films and the like), having not only a tubular configuration but also of the so called single-fold type, i.e. consisting of two layers superimposed to each other in a flat condition and mutually joined only along one longitudinal edge thereof.

A further drawback of the above referenced known apparatus resides in a relatively high risk of failed spreading apart of the edges of the web length each time supplied to the fill-in station, which involves the need of relatively frequent manual interventions.

Additional inconveniences of this known apparatus consist of the difficulty of properly adjusting the pneumatic spreading apart device, and also of a high energy consumption for generating the compressed air supplied to this spreading apart system.

SUMMARY OF THE INVENTION

The object of the present invention is to overcome the above drawbacks, and this object is achieved by a method for the packaging of articles within flexible material bags essentially as defined in claim 1, as well as in the subclaims appended thereto and in claim 13, and by an automatic apparatus for the packaging of articles within flexible material bags essentially as defined in claim 4, in the subclaim appended thereto and in claim 14.

In short summary, the peculiar and fundamental feature of the invention consists of the fact that spreading apart of the edges of the web length, or the like container, every time fed to the fill-in station is performed by a releasable adhesive retention of these edges. Such an idea of solution enables removing any constraint and limitation in connection with the physical properties of the material forming the continuous web, or the like container, thus extending the possibilities of application of the packaging method and apparatus according to the invention to flexible materials of various nature and different thickness, and even to multi-coupled materials, having both a tubular or a single-fold arrangement, and already pre-formed as an envelope or the like flexible bag. Suppression of the pneumatic spreading apart assembly provided for in the packaging apparatus according to the previously mentioned prior art allows avoiding any adjustment problem as well as making the apparatus less expensive both under the manufacturing point of view and in connection with the operation costs, and even any problems related to the risk of failed opening of the web length edges are practically suppressed.

BRIEF DESCRIPTION OF THE DRAWINGS

Further features and advantages of the invention will become apparent from the following detailed description, with reference to the accompanying drawings purely provided by way of non limiting example, in which.

DETAILED DESCRIPTION OF THE DRAWINGS

Figure 1:
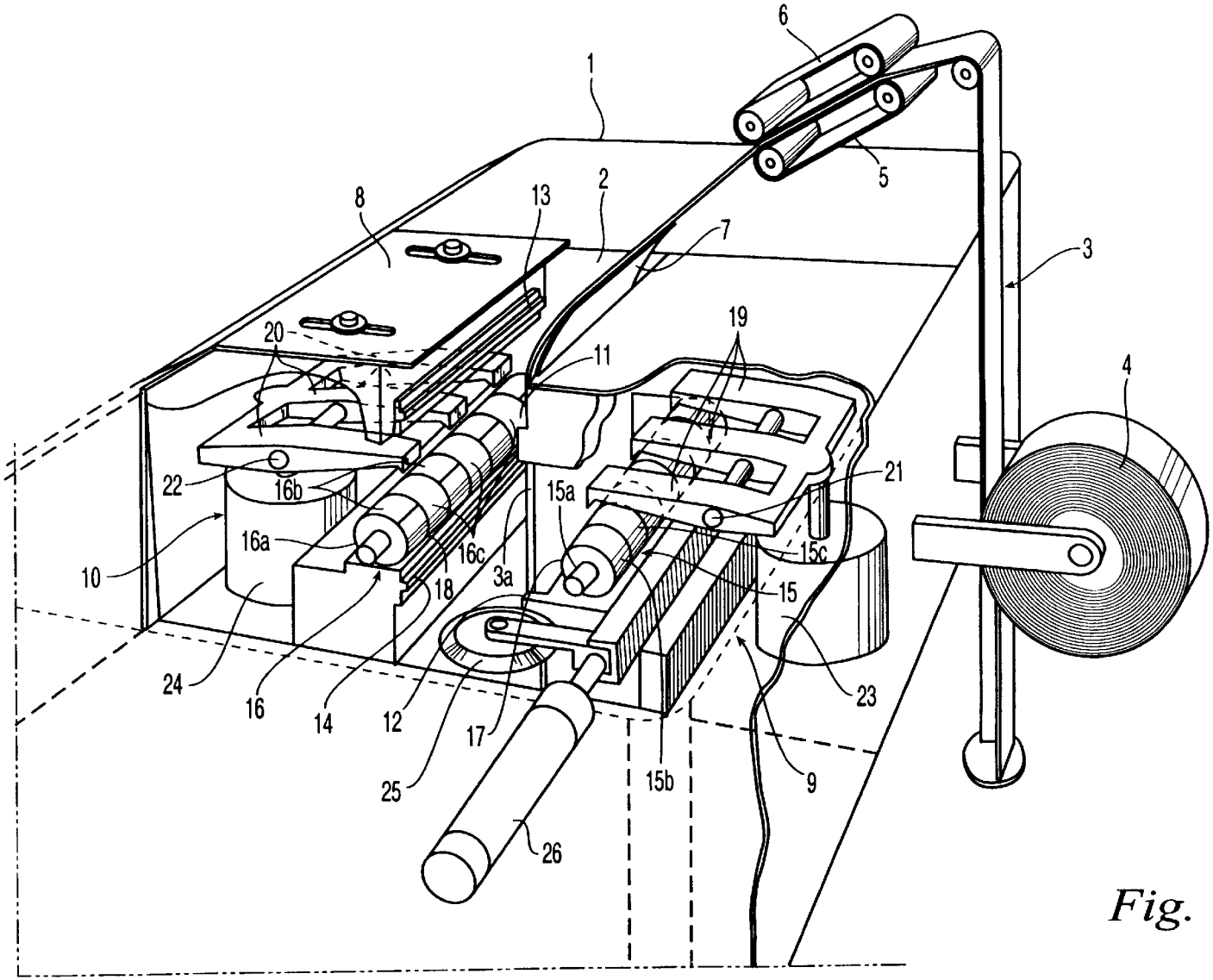
FIG. 1 is a diagrammatic and simplified perspective and partially sectioned view of an automatic packaging apparatus according to the invention.

Referring initially to FIG. 1, an automatic packaging machine according to the invention essentially comprises a structure 1 at an upper area of which a fill-in station generally designated as 2 is defined, to which articles to be packaged within flexible bags are fed either manually or in a mechanised way. These flexible bags are produced starting from a continuous web of heat weldable flexible material 3 wound on a reel 4 supported by the structure 1 and transferred to the fill-in station 2 preferably by means of a pair of juxtaposed motor-driven endless conveyor belts 5, 6. The upper belt 6 may be replaced by a pair of idle rollers.

In the case of the shown example the web 3 is formed by a flattened tubular film, i.e. is constituted by two superimposed film layers joined to each other along both longitudinal edges of the web 3. This film may be made of any material suitable for packaging, and even by layers of mutually coupled different materials provided that these materials include at least one heat weldable component (for instance polyethylene), having a different thickness and in any case even much greater of much lower than those adapted to be employed in the case of the packaging apparatus according to the previously mentioned prior art. Moreover the web 3 may also consist, instead of a tubular film, of a single-fold film, i.e. a film formed by two superimposed flattened layers joined to each other only along one longitudinal edge of the web: in this case the apparatus shall be provided, in addition to the components which shall be disclosed in detail herebelow, with a heat welding assembly of these two layers along the other longitudinal web edge.

Figure 4:
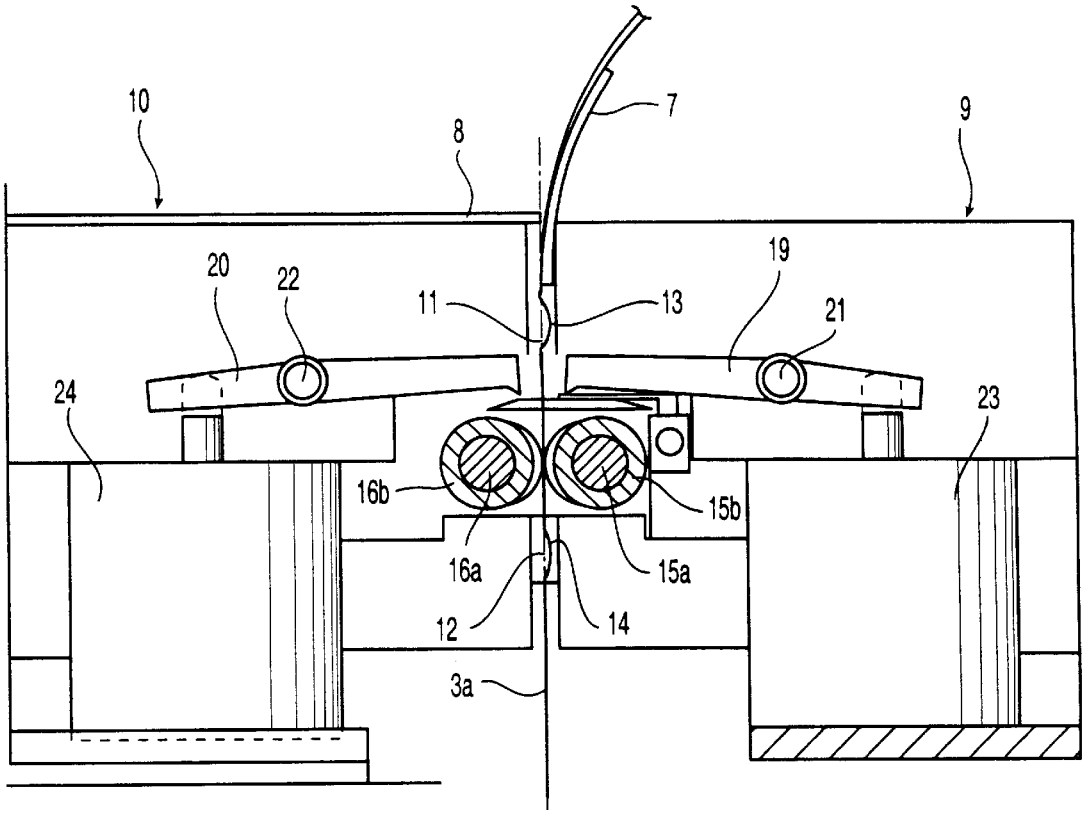
Figure 8:
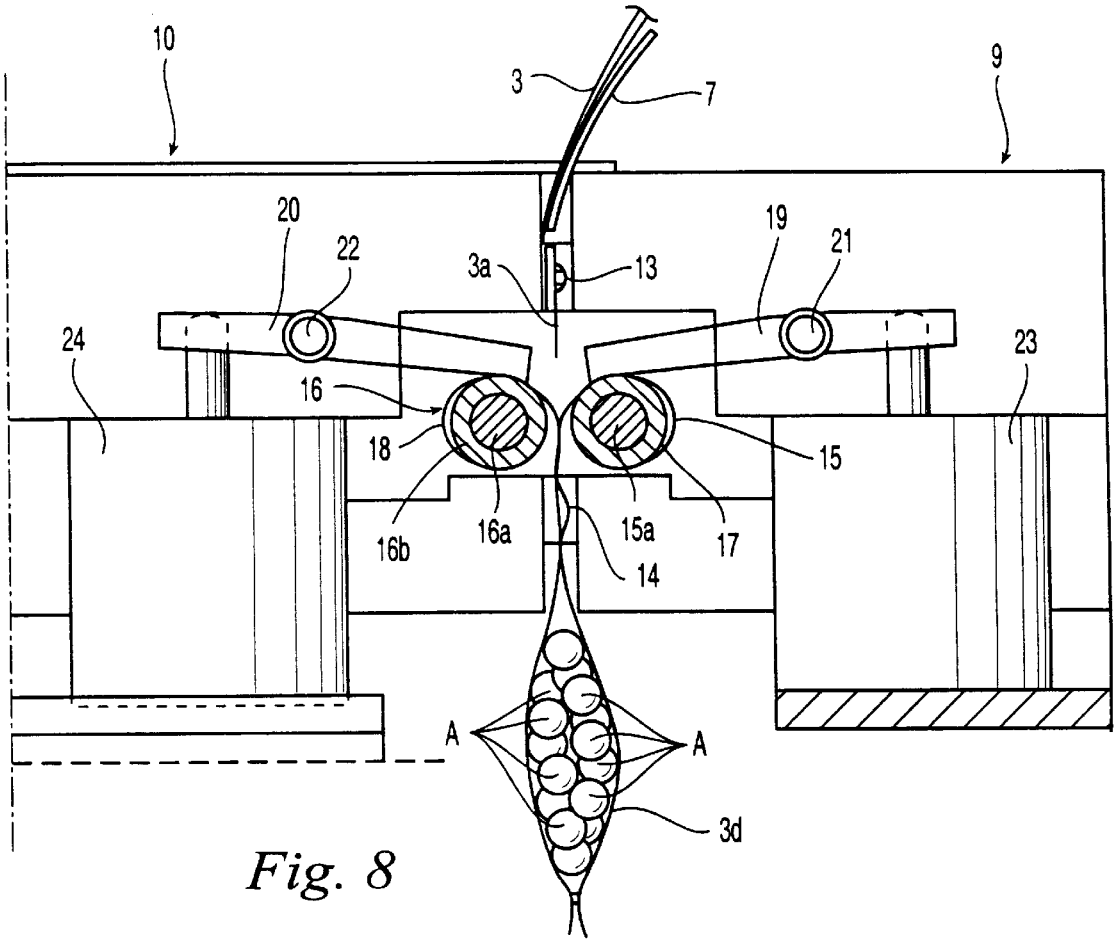

The fill-in area 2 is delimited superiorly at one side by a guiding chute 7 for the web 3, and at the other side by a horizontal cover plate 8 which is slidable, against the action of return spring members, between an advanced position and a retracted position (depicted in FIGS. 4 and 8). The guiding chute 7 deviates the web 3, which is intermittently fed by the conveyors 5, 6 along a substantially vertical direction into the fill-in area 2.

The guiding chute 7 and the slidable cover plate 8 are carried by two operating heads, shown as 9 and 10 respectively, which can be displaced relative to each other in a horizontal direction, i.e. transversely with respect to the portion of the web 3 placed vertically beneath the guiding chute 7.

Both heads 9, 10 can be movable or more conveniently, as in the case of the shown example, the head 9 is stationary while the head 10 can be drawn near and away relative to the head 9. Accordingly the head 10 is slidably mounted along suitable rails, not shown in detail in the drawings for the sake of simplicity, and its reciprocating motion is conveniently operated by an electrical motor, also not shown in the drawings.

The heads 9, 10 carry two heat welding systems including two upper and lower stationary abutting members 11 and 12, respectively, carried by the stationary head 9 and two upper and lower movable heating bars 13 and 14, respectively, carried by the movable head 10 and facing towards the upper abutting member 11 and to the lower abutting member 12, respectively. The abutting members and the heating bars 11, 12, 13, 14 are arranged horizontally and transversely to the portion of the web 3 extending vertically at the fill-in area 2.

Reference numerals 15, 16 designate two rollers rotatably supported respectively by the stationary head 9, in an area comprised between the abutting members 11 and 12, and by the movable head 10, in an area correspondingly comprised between the heating bars 13, 14. The rollers 15, 16 have an identical configuration, including a central shaft 15*a*, 16*a* on which alternated coaxial cylindrical elements 15*b*, 15*c* and 16*b*, 16*c* are rigidly fixed. The cylindrical elements 15*b*, 16*b* carry, over an angular portion of their lateral surface, respective self-adhesive pads 17, 18. These adhesive pads may simply be constituted by bi-adhesive tapes for instance of the type produced and manufactured by 3M under the designation 4658F, whose exposed surface (i.e. the one not adhering onto the cylindrical element 15*b*, 16*b*) is provided with a releasable acrylic adhesive.

The shafts 15*a*, 16*a* of the rollers 15, 16 are oriented like the abutting members 11, 12 and the heating bars 13, 14, and rotation thereof is operated simultaneously but in opposite directions by a reciprocating motor-driven assembly, not shown since within the skill of the practitioner, in the way that shall be clarified in the following.

The cylindrical elements 15*c*, 16*c* of the rollers 15, 16 co-operate with respective swinging shoes 19, 20 rotatably mounted around respective shafts 21, 22 parallel to the rollers 15, 16 and driven by respective fluid operated actuators 23, 24. The shoes 19, 20 can be displaced beaten an inoperative raised position and a lowered position in which their respective free ends abut against the surfaces of the cylindrical elements 15*c*, 16*c*.

Reference numeral 25 designates a knife consisting of a circular blade carried by the stationary head 9 at a level immediately above the roller 15 and displaceable parallely to the latter, along the path of the portion of the web 3 located through the fill-in area 2, by means of a fluid actuator 26.

Operation of the above disclosed packaging apparatus is as follows.

Figure 2:
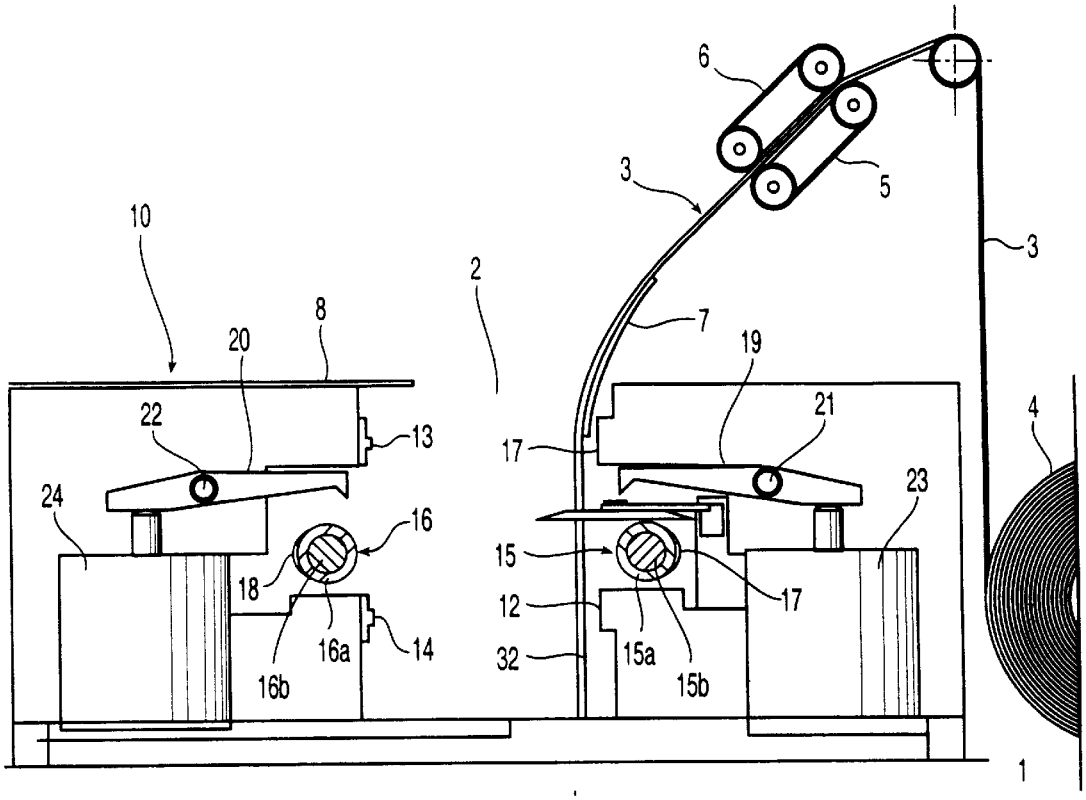
FIG. 2 is front elevational, partially sectioned and simplified view, showing a first operation step of the apparatus according to the invention.

It is assumed starting from the position shown in FIG. 2, in which the movable head 10 is spaced apart from the stationary head 9, the shoes 19, 20 are held in their raised position, and the rollers 15, 16 are angularly arranged with the respective adhesive pads 17, 18 facing towards opposite sides with respect to the fill-in area 2. A predetermined length 3*a* of the web 3, transferred by the conveyor belts 5, 6, is positioned substantially vertically in correspondence of the fill-in area 2.

Figure 3:
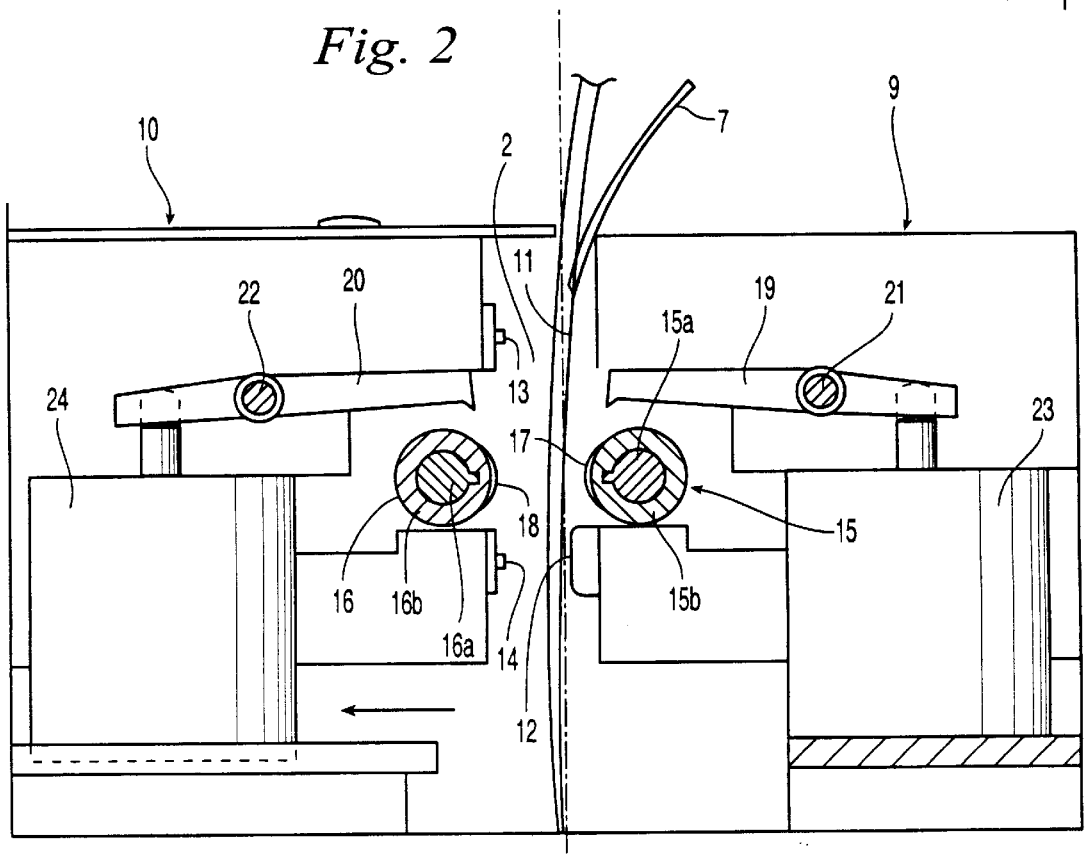
FIGS. 3–9 are views same as FIG. 2, further simplified and in an enlarged scale, showing respective successive operation steps of the apparatus.

In a first step (FIG. 3) the rollers 15, 16 are rotated by 180° in opposite directions, so as to position the respective adhesive pads 17, 18 in a juxtaposed condition with respect to the web length 3*a*. Simultaneously the movable head 10 is brought near the stationary head 9, whereby the movable plate 8 abuts against the chute 7 thus closing from above the fill-in area 2. Following displacement of the movable head 10 relative to the stationary head 9, the adhesive pad 17, 18 of the two rollers 15, 16 are pressed from opposite sides against the web length 3*a*, thus adhering onto the corresponding layers of the web itself. The web length 3*a* is then severed from the web 3 by the circular knife 25 operated by the actuator 26 (FIG. 4).

Figure 5:
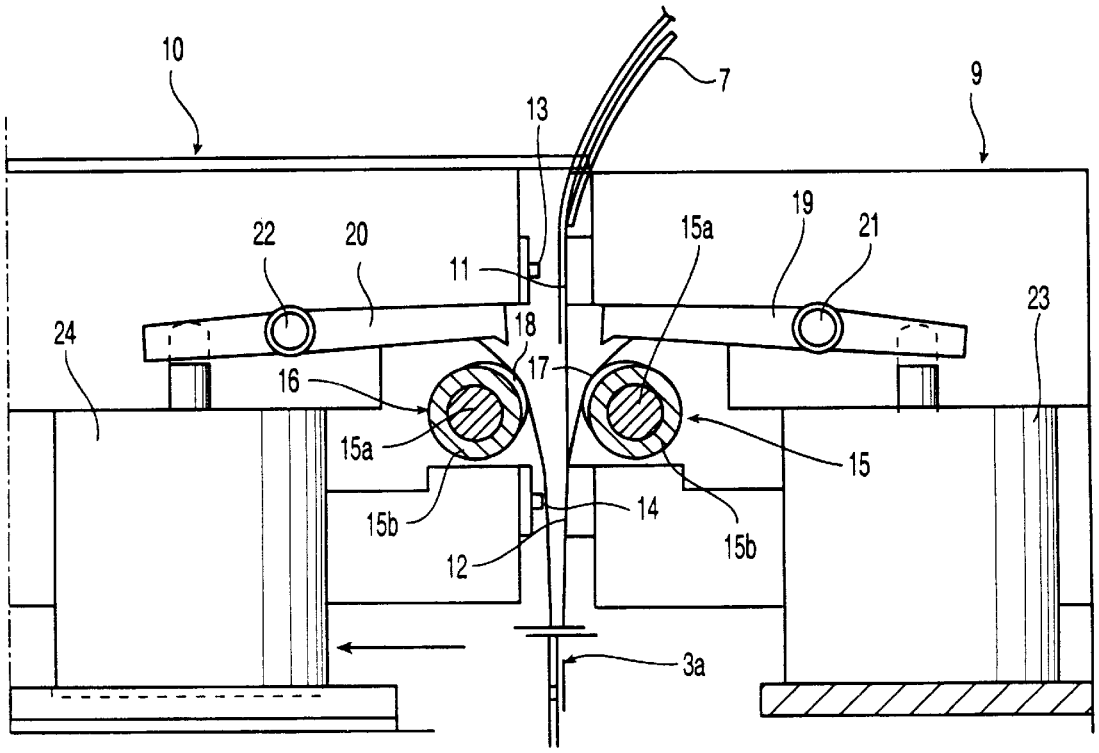

The subsequent step consists of spreading apart the cut edges 3*b*, 3*c* of the web length 3*a*, which are adhering to the adhesive pads 17, 18 of the respective rollers 15, 16: this is performed by means of a combined motion of a partial withdrawal of the movable head 10 relative to the stationary head 9 and upward rotation of the rollers 15, 16 such as depicted in FIG. 5.

Figure 6:
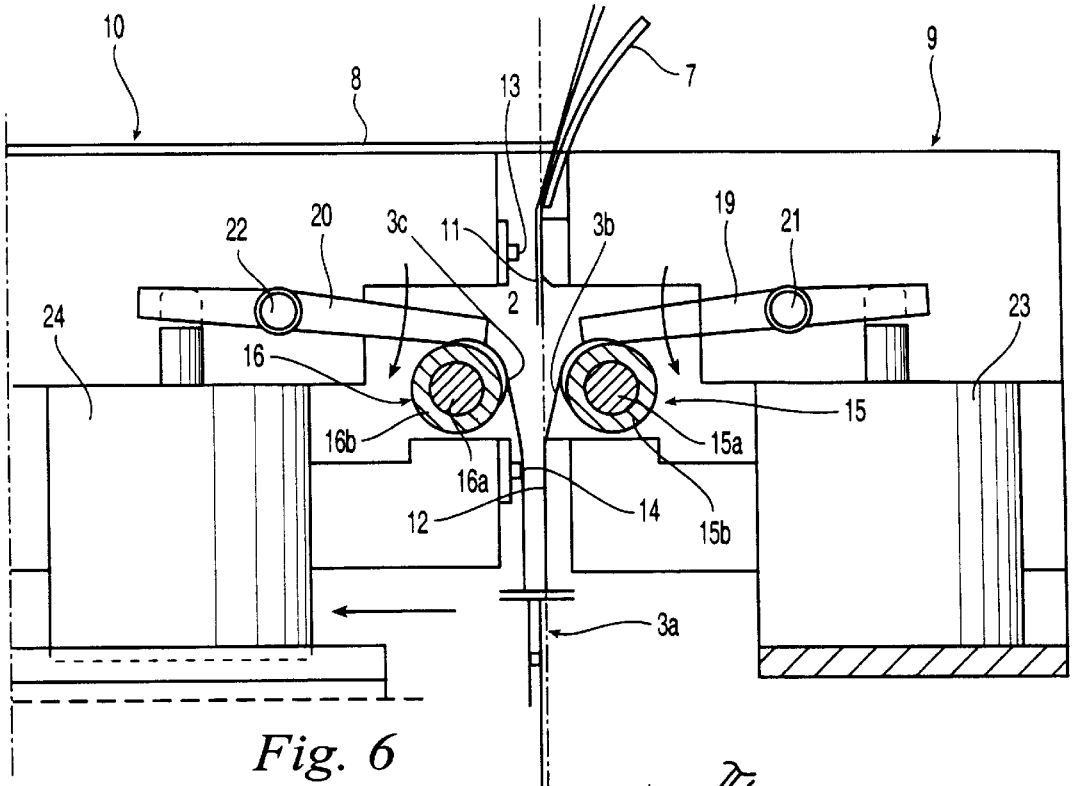

Then lowering of the swinging shoes 19 is operated, such as shown in FIG. 6, so as to provide firm hold of the edges

3*b*, 3*c* against the cylindrical elements 15*c*, 16*c* of the rollers 15, 16, in addition to the adhesive grasp provided by the pads 17, 18.

Figure 7:
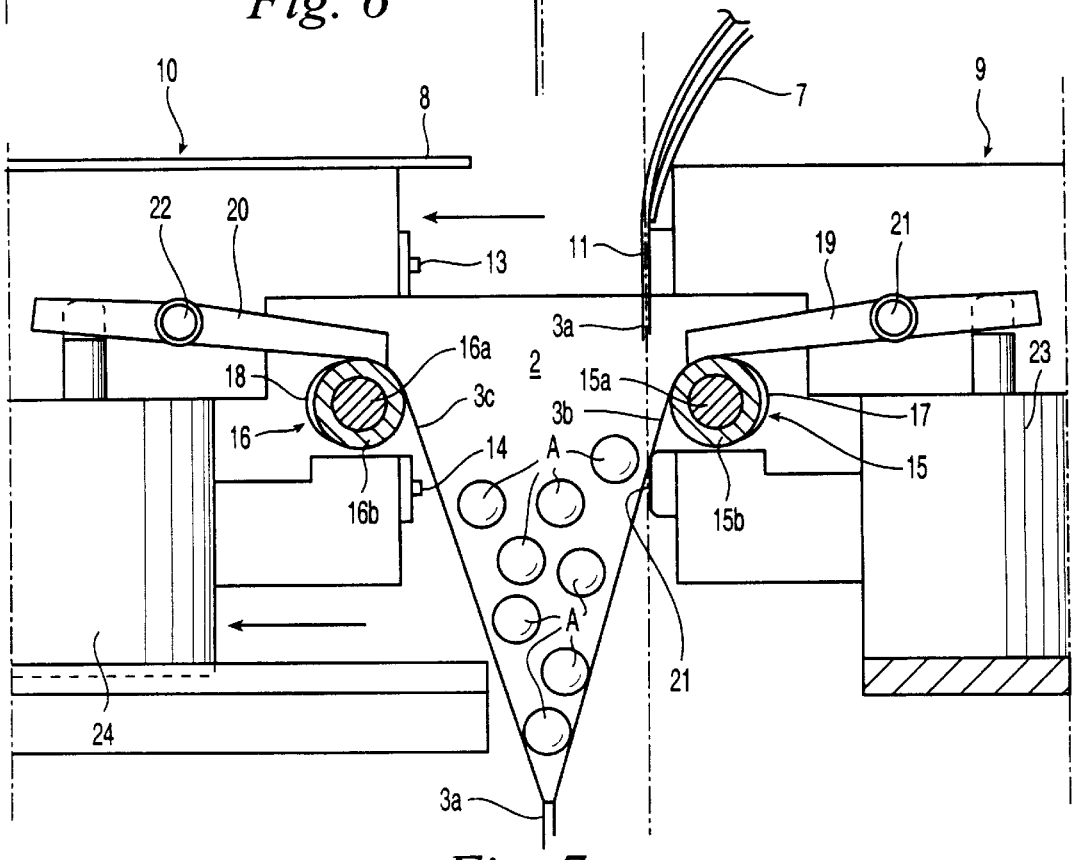

The two rollers 15, 16 are then further rotated so as to position the adhesive pads 17, 18 in a condition wherein these rollers are facing towards opposite sides with respect to the fill-in area 2, while simultaneously (or immediately afterwards) the movable head 10 is completely moved away from the stationary head 9. Thus the edges 3*b*, 3*c*, previously simply spread apart from each other, are mutually moved away to such an extent so as to enable introduction of the articles A to be packed therethrough, such as depicted in FIG. 7.

At the end of the filling up step the movable head 10 is again brought near and closed against the stationary head 9, and activation of the two heat welding assemblies constituted by the abutting members 11, 12 and bars 13, 14 is operated. The upper heat welding assembly 11, 13 performs closing of the lower end of the web length 3 which shall be subsequently fed to the fill-in station 2, while the lower heat welding assembly 12, 13 performs closing of the edges 3*b*, 3*c* immediately beneath the rollers 15, 16. Thus forming of a sealed bag 3*d* containing the articles A is completed. This sealed bag 3*d* is discharged into a suitable lower collecting chute, not shown in the drawings, simply upon opening of the pads 19, 20 and releasing the edges 3*b*, 3*c* by the adhesive pads 17, 18 of the rollers 15, 16, under gravity due to the weight of the thus packaged articles A.

Figure 10:
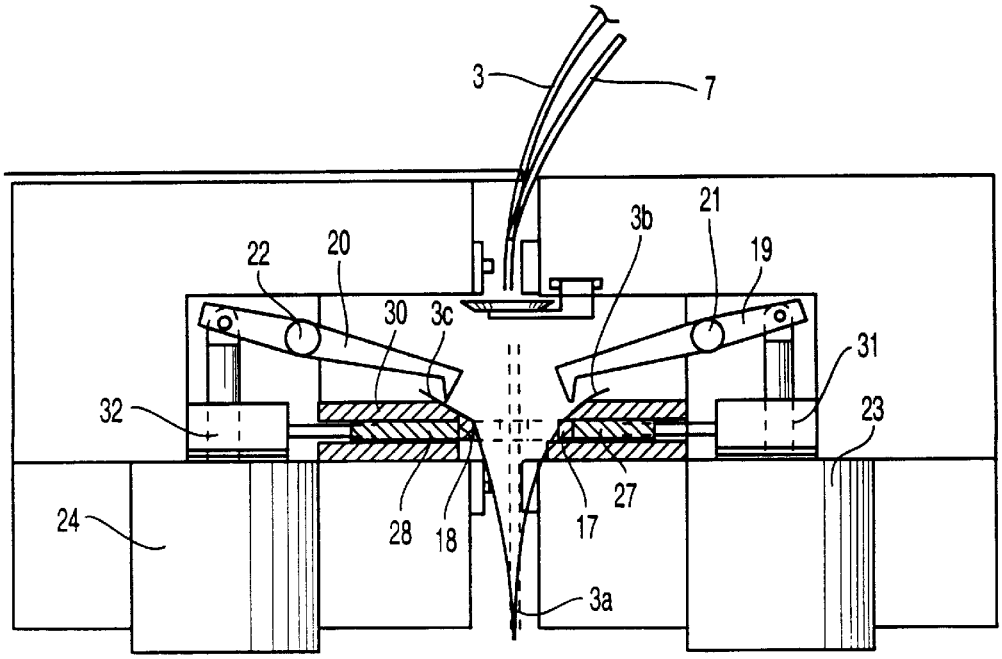
FIG. 10 is a view same as FIG. 6 showing an alternative embodiment of the apparatus according to the invention.
Figure 9:
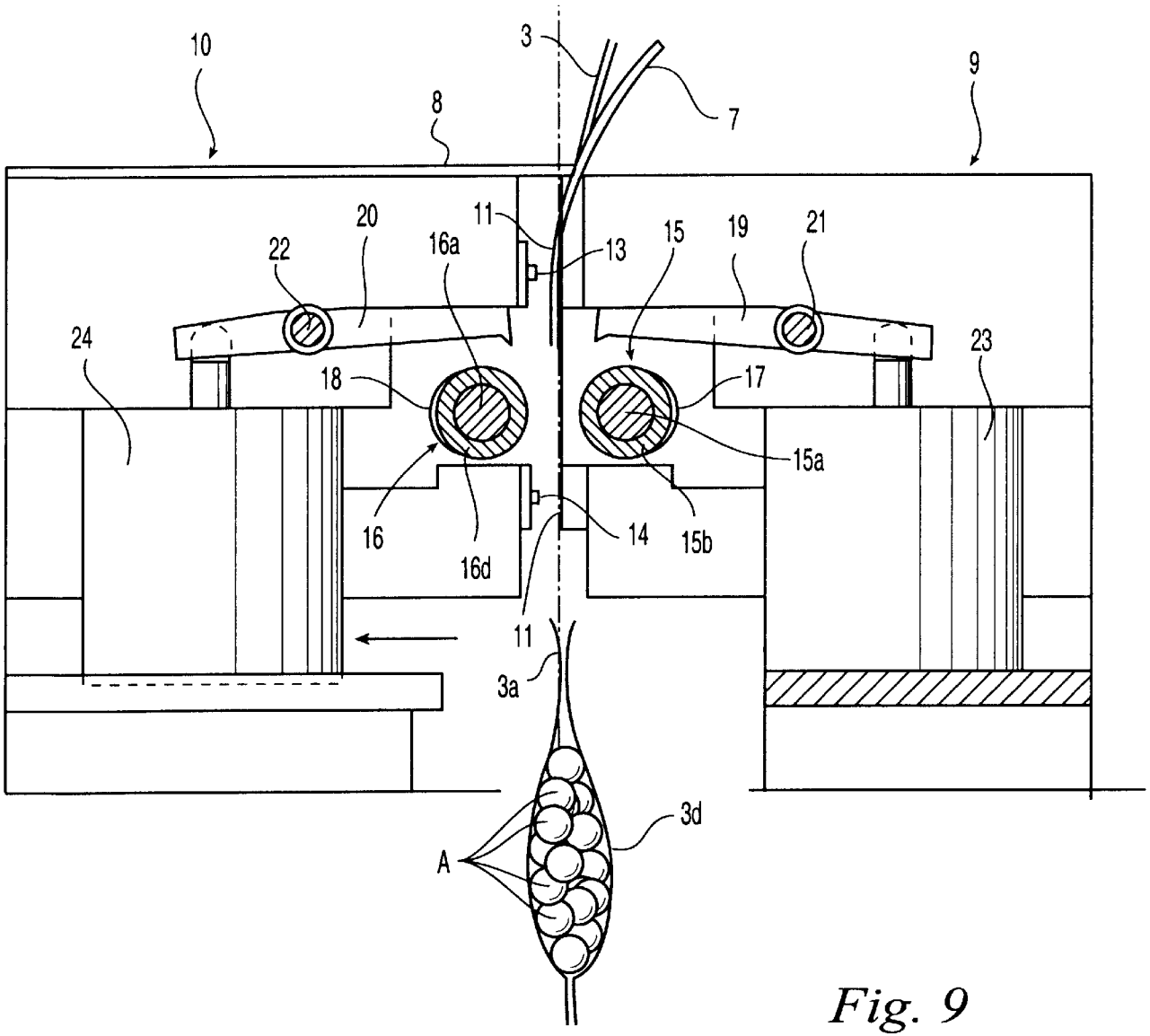

In the above disclosed embodiment shifting of the adhesive pads 17, 18 from the mutually distal inoperative position to the grasp proximal position of the edges 3*b*, 3*c* is carried out, as previously explained, following rotation of the rollers 15, 16 in opposite directions. The same functional effect may be achieved by means of a linear displacement of the adhesive pad in opposite directions. This alternative embodiment is diagrammatically shown in FIG. 10, in the position corresponding to that previously disclosed with reference to FIG. 6, i.e. with the edges 3*b*, 3*c* of the web length 3*a* spread apart and held by the respective shoes 19, 20. In this embodiment the rollers 15, 16 are replaced by two bars 27, 28 which are linearly displaceable in opposite directions transversely to the web length 3*a*, by means of respective actuators 31, 32. The adhesive pads 17, 18 are normally secured continuously along the outer edges of the bars 27, 28 and the shoes 19, 20 co-operate with respective stationary abutting elements 29, 30 provided above the slidable bars 27, 28.

Operation of this alternative embodiment is generally same as already disclosed in the above.

In both embodiments the apparatus according to the invention is provided with a check and control electronic system for operating the several above-disclosed motor driven components in a synchronised way according to successive sequential operative cycles. This check and control system, not shown in detail since within the skill of the practitioner, obviously may be programmable so as to adjust the operation cycle of the apparatus to the user's demand.

Moreover, in both embodiments the adhesive pads 17, 18 can easily and quickly be removed and periodically replaced.

Naturally the details of construction, the embodiments and the application modes of the invention may be widely varied with respect to what has been disclosed and illustrated, without thereby departing from the scope of the appended claims.

Thus, for instance, while the idea of solution upon which the present invention is based has been disclosed by way of example with explicit reference to a packaging apparatus employing a continuous web, the invention can be equally advantageously applied to packaging systems employing envelopes or the like flexible materials containers already pre-formed according to a substantially flat configuration, with two edges adapted to be mutually spread apart so as to allow introduction of the articles to be packaged therethrough.

What is claimed is:

1. An automatic apparatus for the packaging of articles within flexible material bags, particularly made of heat-weldable plastic material, comprising a fill-in area, supply means to feed intermittently to the fill-in area a continuous web made of said flexible material formed by two mutually superimposed flat layers having respective longitudinal edges and joined to each other along at least one longitudinal edge thereof, cutting means to cut said continuous web transversely so as to form a web length of a desires size, spreading apart means to spread apart said cut edges of said web length, retaining means to hold said edges during filling up of said articles, and means to sealingly close said web length, wherein said means for spreading apart said edges of said web length comprise releasable adhesive grasp members displaceable between a mutually distal inoperative position and a proximal contact position with said edges, wherein said adhesive grasps members include a pair of roller means rotatable around respective axes oriented transversely of the web length and carrying respective self adhesive pad members, abutting means associated with said roller means, said abutting means being unprovided with said self adhesive pad members said retaining means include swing shoes tiltable between an inoperative position and an operative position in which said shoes press said cut edges of said web length against said abutting means, and further including support means carrying said roller means, said abutting means and said swing shoes, said support means being displaceable relative to each other along a direction perpendicular to said web length between a mutually proximal position and a mutually distal position.

2. Apparatus according to claim 1, further comprising two heat welding assemblies carried by said support means upstream and downstream of said rollers, respectively.

3. Apparatus according to claim 1, wherein said cutting means comprise a circular blade.

4. Apparatus according to claim 1, wherein said supply means to feed said web to said fill-in area include a pair of motor-driven endless belt conveyors arranged on opposite sides of said web.

5. Apparatus according to claim 1, wherein said adhesive grasp members include a pair of bars linearly displaceable in opposite directions transversely of said web length and carrying respective self-adhesive pads, and actuator means to operate simultaneous displacement of said bars between said distal position and said proximal position.

* * * * *